US006483488B1

(12) United States Patent
Miyazaki

(10) Patent No.: US 6,483,488 B1
(45) Date of Patent: Nov. 19, 2002

(54) DISPLAY APPARATUS AND METHOD OF DRIVING THE DISPLAY APPARATUS

(75) Inventor: Shigeki Miyazaki, Gifu (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/457,136

(22) Filed: Dec. 9, 1999

(30) Foreign Application Priority Data

Dec. 16, 1998 (JP) ..... 10-357743

(51) Int. Cl.[7] ..... G09G 3/28; G09G 3/10

(52) U.S. Cl. ..... 345/60; 315/169.4

(58) Field of Search ..... 345/60, 67, 68, 345/87, 95, 96, 98, 99, 100, 103; 349/32, 33, 139, 143; 313/584, 585, 586, 587; 315/169.4

(56) References Cited

U.S. PATENT DOCUMENTS 4,896,149 A * 1/1990 Buzak et al. ..... 340/794
5,361,080 A * 11/1994 Kwon ..... 345/87
5,408,245 A * 4/1995 Kakizaki ..... 345/60
5,657,035 A * 8/1997 Miyazaki ..... 345/60
5,805,122 A * 9/1998 Bongaerts et al. ..... 345/60

* cited by examiner

*Primary Examiner*—Bipin Shalwala
*Assistant Examiner*—Jeff Piziali
(74) *Attorney, Agent, or Firm*—Sonnenschein, Nath & Rosenthal

(57) ABSTRACT

A PALC display apparatus comprising groups of cathode electrodes K and groups of anode electrodes A, each group consisting of, for example, three electrodes. The cathode electrodes of each group are connected by a multi-connection line KK, and the anode electrodes of each group are connected by a multi-connection line AA. Thus, a plurality of multi-connection lines KK and a plurality of multi-connection lines AA are provided. Of these multi-connection lines, two lines KK and two lines AA are selected. A voltage is applied to the cathode electrodes K connected by the selected multi-connection lines KK, and a voltage of the opposite polarity is applied to the anode electrodes A connected by the selected multi-connection lines AA. Discharge is thereby effected between the selected electrodes only. Therefore, the PALC display apparatus can be manufactured at low cost and can display high-quality images.

4 Claims, 14 Drawing Sheets

X1=K1:A1
X2=K2:A2
X3=K3:A3
X4=K4:A4
X5=K5:A5
X6=K6:A6
X7=K7:A7
X8=K8:A8
X9=K9:A9
X10=K10:A10
X11=K11:A11
X12=K12:A12
X13=K13:A13
X14=K14:A14
X15=K15:A15
X16=K16:A16
X17=K17:A17
X18=K18:A18
⋮

X1=KK1:AA1
X2=KK1:AA2
X3=KK1:AA3
X4=KK2:AA1
X5=KK2:AA2
X6=KK2:AA3
X7=KK3:AA1
X8=KK3:AA2
X9=KK3:AA3
X10=KK4:AA4
X11=KK4:AA5
X12=KK4:AA6
X13=KK5:AA4
X14=KK5:AA5
X15=KK5:AA6
X16=KK6:AA4
X17=KK6:AA5
X18=KK6:AA6

X1=KK1 : AA1AA4
X3=KK2 : AA2AA5
X5=KK3 : AA3AA6
X7=KK1 : AA2AA5
X9=KK2 : AA3AA6
X11=KK3 : AA1AA4
X13=KK1 : AA3AA6
X15=KK2 : AA1AA4
X17=KK3 : AA2AA5
. . .

X2=KK4 : AA4AA2
X4=KK5 : AA5AA3
X6=KK6 : AA6AA2
X8=KK4 : AA5AA3
X10=KK5 : AA6AA1
X12=KK6 : AA4AA3
X14=KK4 : AA6AA1
X16=KK5 : AA4AA2
X18=KK6 : AA5AA3
. . .

DISPLAY APPARATUS AND METHOD OF DRIVING THE DISPLAY APPARATUS

FIELD OF THE INVENTION

This invention relates to a display apparatus, wherein an electrooptic layer is driven by the use of plasma to select pixels, and to a method of driving the display apparatus.

BACKGROUND OF THE INVENTION

In recent years, various display apparatuses are available. Among them are display apparatuses having a PDP (Plasma Display Panel), display apparatuses having a TFT (Thin-Film Transistor) liquid crystal display, and display apparatuses having a plasma-addressing liquid crystal display (hereinafter called PALC display). The PALC display apparatus, in particular, attracts attention, because it can provide a large screen.

FIG. 1 shows the basic structure of the PALC display apparatus.

As shown in FIG. 1, the PALC display apparatus comprises a liquid crystal layer 101 made of electrooptic material, plasma chambers 102, and a thin dielectric sheet 103 that is made of glass or the like. The layer 101 opposes the chambers 102, with the sheet 103 interposed between it and the chambers 102.

The plasma chambers 102 are defined by a plurality of parallel grooves 105 made in a surface of a glass substrate 104. The chambers 102 are filled with gas that can be ionized. A pair of electrodes 106 and 107, which extend parallel to each other, is provided in each of the grooves 105. The electrodes 106 and 107 of each pair are an anode A and a cathode K, which ionize the gas in the plasma chamber 102, thereby generating discharge plasma.

The liquid crystal layer 101 is held between the dielectric sheet 103 and a transparent substrate 108. Transparent electrodes 109 are provided on that surface of the transparent substrate 101 which opposes the liquid crystal layer 101. The transparent electrodes 109 extend at right angles to the grooves 105 that define the plasma chambers 102. The intersections of the plasma chambers 102 and the transparent electrodes 109 correspond to pixels.

In this display apparatus, the plasma chambers, in which plasma discharge is effected, are sequentially scanned, and a signal voltage is applied to the transparent electrodes 109 contacting the liquid crystal layer 101 as the plasma chambers are thus scanned. As a result, the pixels hold the signal voltage, thereby driving the liquid crystal layer 101.

Each groove 105, or each plasma chamber 102, corresponds to one scanning line. The chamber 102 is divided into discharge regions, which define unit-scanning spaces.

FIG. 2 is a schematic representation of the PALC display apparatus, illustrating the arrangement of the transparent electrodes 109, anode electrodes A and cathode electrodes K.

The transparent electrodes 109 are connected to a transparent electrode driving section, which comprises a data driver circuit 110 and an output amplifiers 111. The analog voltage output from each amplifier 111 is supplied as a liquid-crystal drive signal.

The cathode electrodes K1 to Kn are connected to a cathode driving section, which comprises a data strobe circuit 112 and output amplifiers 113. More specifically, the cathode electrodes K1 to Kn are connected to the output amplifiers 113, respectively. Each output amplifier 113 outputs a pulse voltage, which is applied, as a data strobe signal, to the corresponding cathode electrode. A reference voltage (i.e., ground voltage) is applied to all anode electrodes A1 to An.

The anode electrodes A and the cathode electrodes K are connected as is illustrated in FIG. 3.

The display apparatus has a scanning control circuit 114, which is connected to the data driver circuit 110 and data strobe circuit 112. The scanning control circuit 114 serves to display an image on the entire screen of the display apparatus. The circuit 114 is designed to adjust the functions of the data driver circuit 110 and data strobe circuit 112 in order to designate addresses of lines, one after another, for all columns of pixels in the liquid crystal layer 101.

In the display apparatus, the liquid crystal layer 101 operates as a capacitor for sampling the analog voltage applied to the transparent electrodes 109. The discharge plasma generated in the plasma chambers 102 operates as a sampling switch. As the layer 101 and the plasma so operate, the display apparatus displays images.

In the PALC display apparatus, the plasma channels may be sequentially scanned, from the uppermost one to the lowermost one, and the liquid-crystal drive signal may be supplied to the liquid crystal layer 102 (more specifically, to the transparent electrodes 109) as the plasma channels are so scanned. In this case, plasma discharge takes place between the anode electrodes A, on the one hand, and the cathode electrodes K, on the other, as is illustrated in FIG. 4. FIG. 5 shows the waveform of the liquid-crystal drive signal supplied to the transparent electrodes 109 in this case. The numbers identifying the anode electrodes A and cathode electrodes K in FIG. 4 indicate the order in which the anode electrodes and the cathode electrodes are arranged in the same column. Each letter x in FIG. 4 shows the position where plasma discharge occurs between one cathode electrode K and the corresponding anode electrode A. The numbers added to the letters x represents the order in which the plasma discharge takes place.

For instance, plasma discharge occurs at position x1 between the cathode electrode K1 and the anode electrode A1, and at position x2 between the cathode electrode K2 and the anode electrode A2. Similarly, plasma discharge takes place at position xm between the cathode electrode Km and the anode electrode Am, at position xm+1 between the cathode electrode Km+1 and the anode electrode Am+1, and a position xm+2 between the cathode electrode Km+2 and the anode electrode Am+2.

In FIG. 5, LCm is the waveform of the liquid-crystal drive signal that is supplied to the transparent electrodes 109 arranged in the horizontal direction. L1 to L9 in FIG. 5 indicate the times at which horizontal scanning is performed. In the case illustrated in FIGS. 4 and 5, the anode electrodes A are always at a constant potential (0 V), while the potentials of, for example, the cathode electrodes Km, Km+1 and Km+2 are switched between 0 V and −400 V, thereby to cause discharge in these plasma channels.

The manufacturing costs of the drive circuit incorporated in the PALC display apparatus is high. It is therefore difficult for the PALC display apparatus to avail commercially. The manufacturing costs of the drive circuit is high for two reasons. Primarily, the drive circuit has many output terminals. Secondly, the drive voltages output from these output terminals are high. In a PALC display apparatus of VAG (Video Graphics Array) standard, which has image resolution of 640×480 pixels, the drive circuit needs to have 480 discharge output terminals to achieve the switching of the cathode electrodes. In addition, the drive voltage output from each output terminal may amount to 400 V in some cases.

SUMMARY OF THE INVENTION

The present invention has been made in view of the foregoing. The object of the invention is to provide a PALC display apparatus that can be manufacture at low cost and display images of high quality, and to provide a method of driving the PALC display apparatus.

According to the invention, there is provided a display apparatus which comprises: a first electrode layer having a plurality of first electrodes extending substantially parallel to one another; a second electrode layer having a plurality of second electrodes extending substantially parallel to one another, each composed of at least one pair of discharge electrodes, and arranged with the second electrodes opposing the first electrodes and extending to the first electrodes; and electrooptic layer provided between the first electrode layer and the second electrode layer and substantially contacting the first electrode layer, to be driven by said at least one pair of discharge electrodes; and a discharge region provided between the first electrode layer and the second electrode layer, filled with gas that can be ionized, and having barrier ribs extending substantially parallel to the second electrodes. The apparatus further comprises: connection means dividing the second electrodes into groups and connecting the discharge electrodes included in each group to one another; and voltage-applying means for applying two voltages of the opposite polarities to selected two of the groups, respectively.

According to the invention, there is provided a method of driving a display apparatus of this type.

In the display apparatus and the method of driving the apparatus, both according to the present invention, a voltage is applied to the discharge electrodes at the same position, with a time lag of at least one scanning period, thereby to perform sequential line scanning.

DESCRIPTION OF THE PREFERRED EMBODIMENTS

Preferred embodiments of the present invention will be described, with reference to the accompanying drawings.

So-called AND theory, which consists in the multi-line connection of electrodes, is applied to the display apparatus according to this invention and the method of driving the display apparatus. The multi-line connection can reduce the number of circuit outputs, thereby not only to decrease the manufacturing cost of the display apparatus, but also to lower the drive voltage. The multi-line connection of electrodes, based on the AND theory, has not been applied in practice to display apparatuses such as color television receivers.

Figure 15:
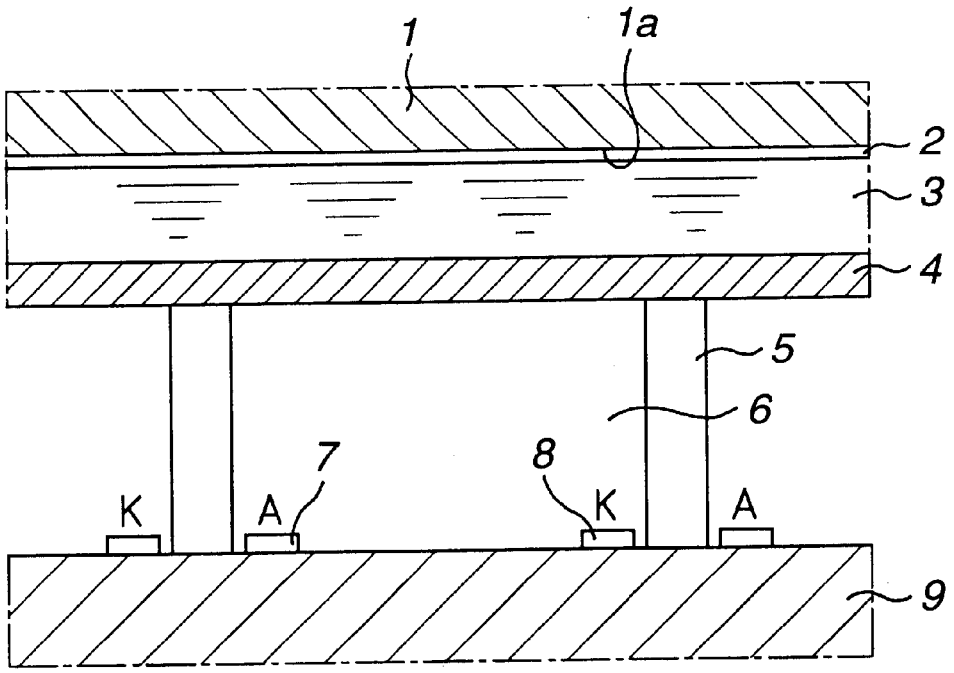
FIG. 15 is a diagram showing a discharge channel arrangement, in which two electrodes drive one discharge channel.
Figure 16:
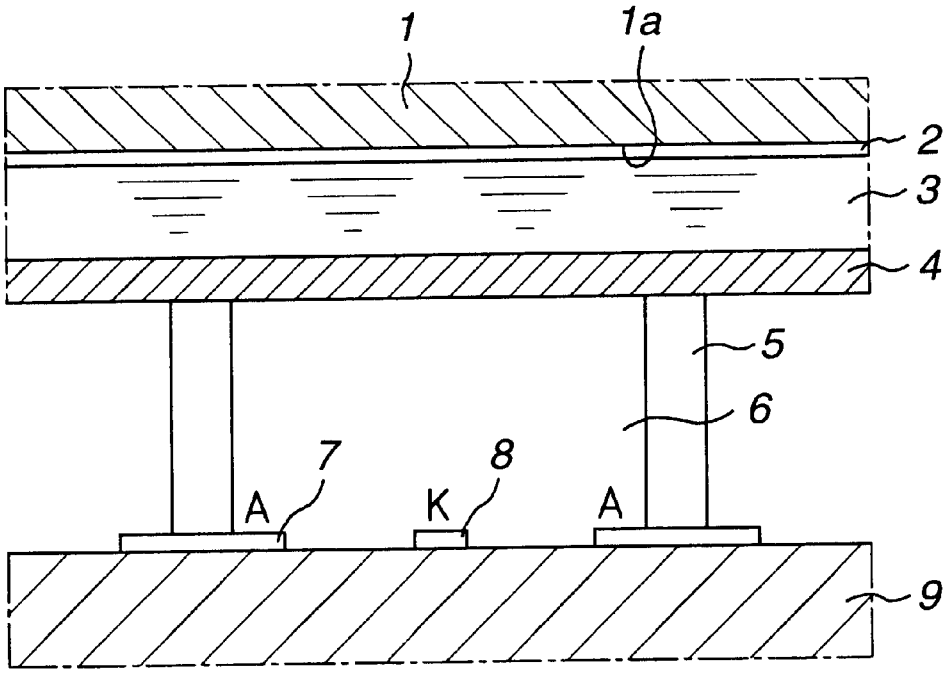
FIG. 16 is a diagram showing a discharge channel arrangement, in which three electrodes drive one discharge channel.

Some variations of discharge channel arrangements are available for use in PALC display apparatuses. Two variations are illustrated in FIGS. 15 and 16. The discharge channel arrangement shown in FIG. 15 is a basic one, in which two electrodes drive one discharge channel. In the discharge channel arrangement of FIG. 16, which will be described later, three electrodes drive one discharge channel, and at least one of the three electrodes serves to drive another discharge channel. Thus, a display apparatus of the present invention, which has specific discharge channel arrangement, is driven by a method, and another display apparatus of this invention, which has a different discharge channel arrangement, is driven by a different method. Typical examples of the discharge channel arrangements designed for PALC display apparatuses will be described later.

First Embodiment

Figure 1:
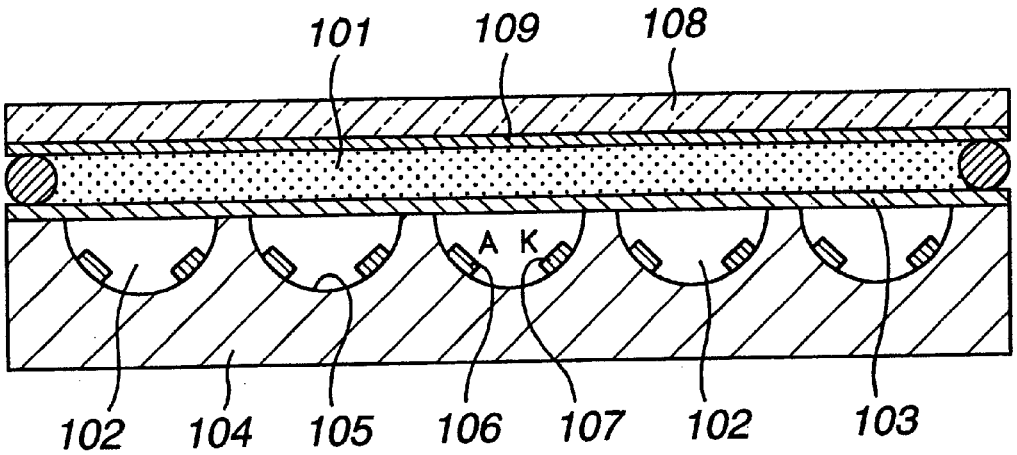
(RELATED ART) FIG.1
FIG. 1 is a diagram showing the basic structure of a conventional PALC display apparatus.
Figure 2:
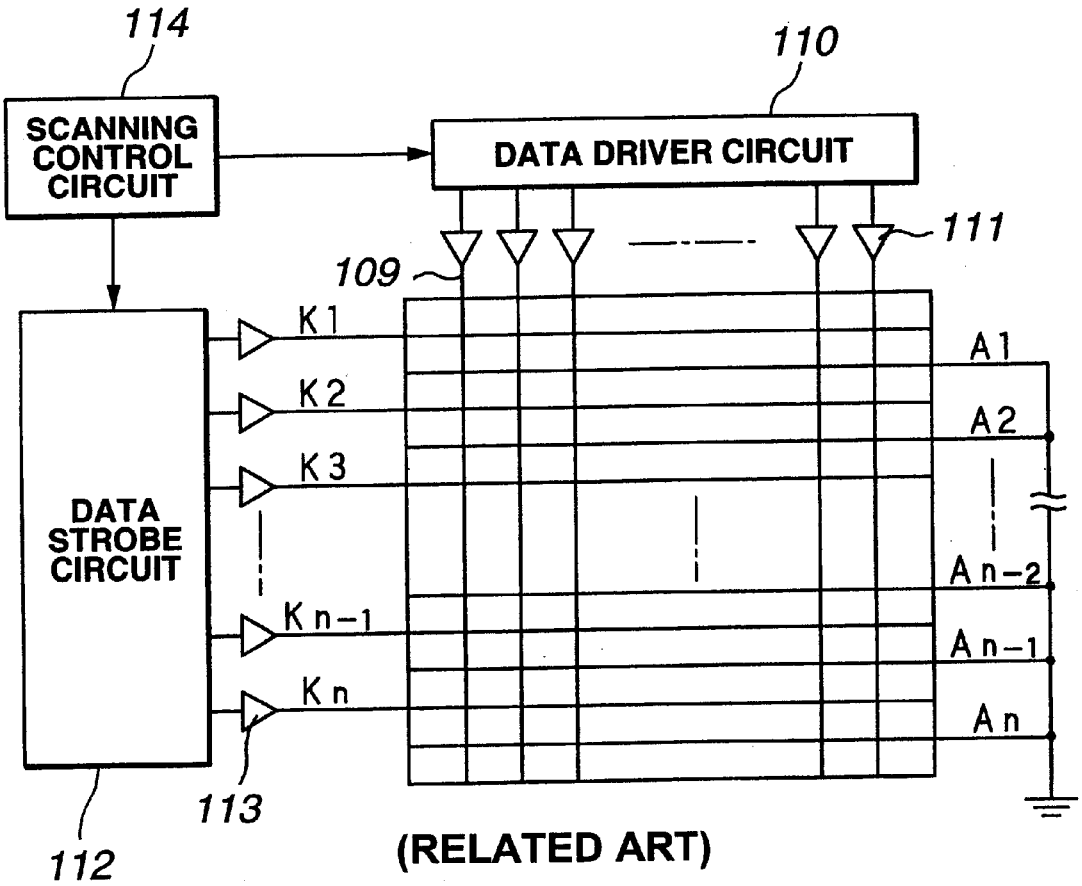
(RELATED ART) FIG.2
FIG. 2 is a block circuit diagram, or a schematic representation of the conventional display apparatus.
Figure 3:
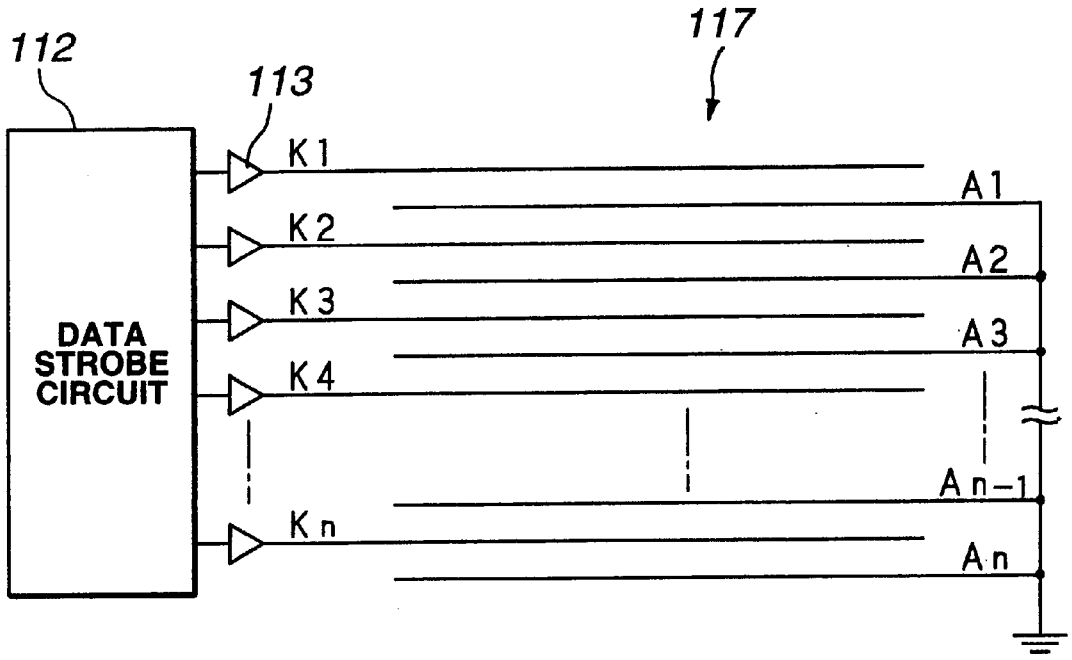
(RELATED ART) FIG.3
FIG. 3 is a diagram illustrating the connection of the anode electrodes and cathode electrodes, provided in the conventional display apparatus.
Figure 4:
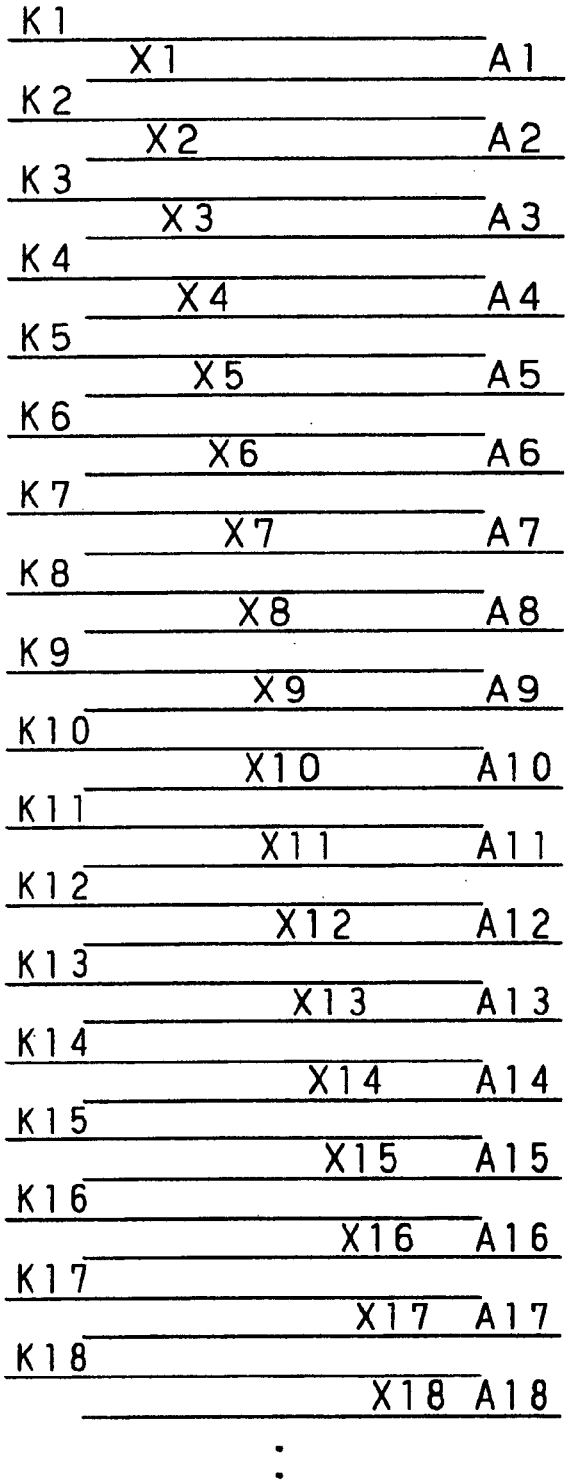
(RELATED ART) FIG.4
FIG. 4 is a diagram for explaining the plasma discharge effected between each anode electrode and the cathode electrode corresponding thereto, in the conventional display apparatus.
Figure 5:
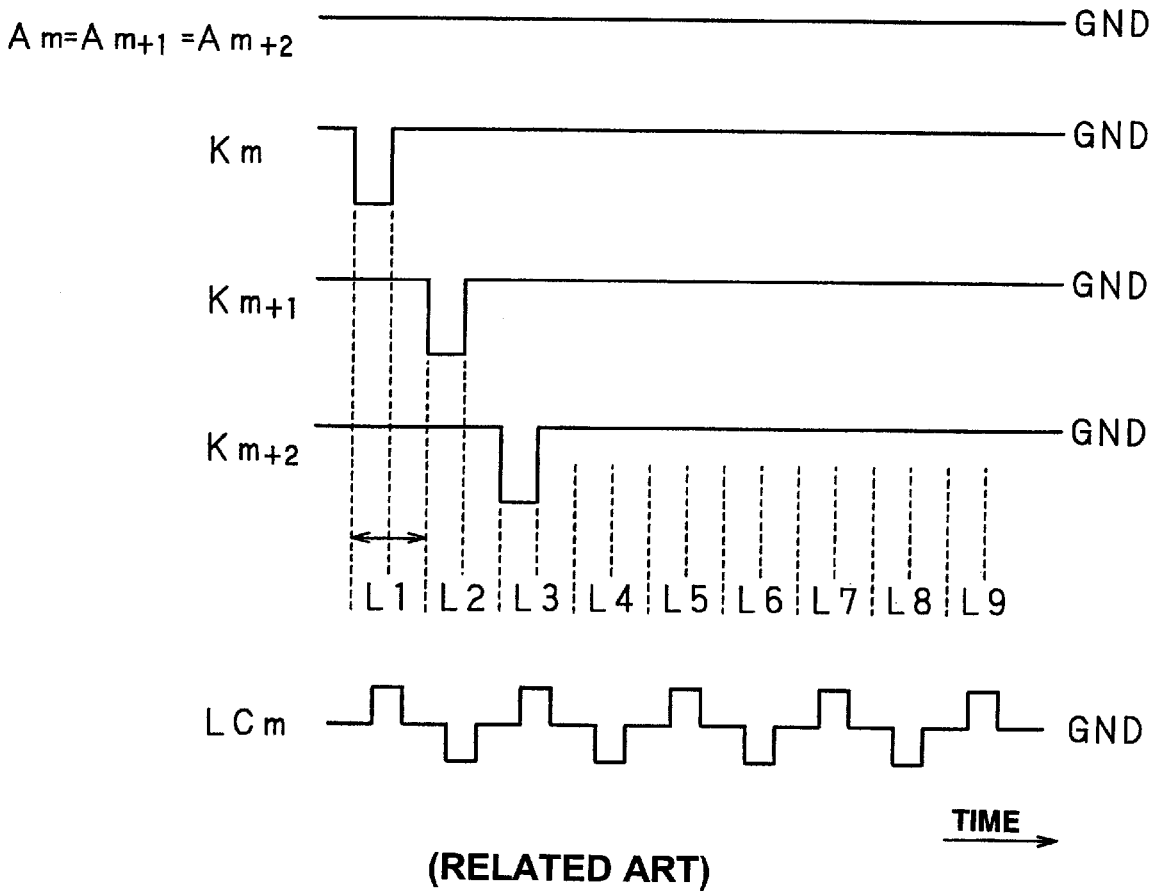
(RELATED ART) FIG.5
FIG. 5 is a chart showing the waveforms of the drive signals used in the conventional display apparatus.
Figure 6:
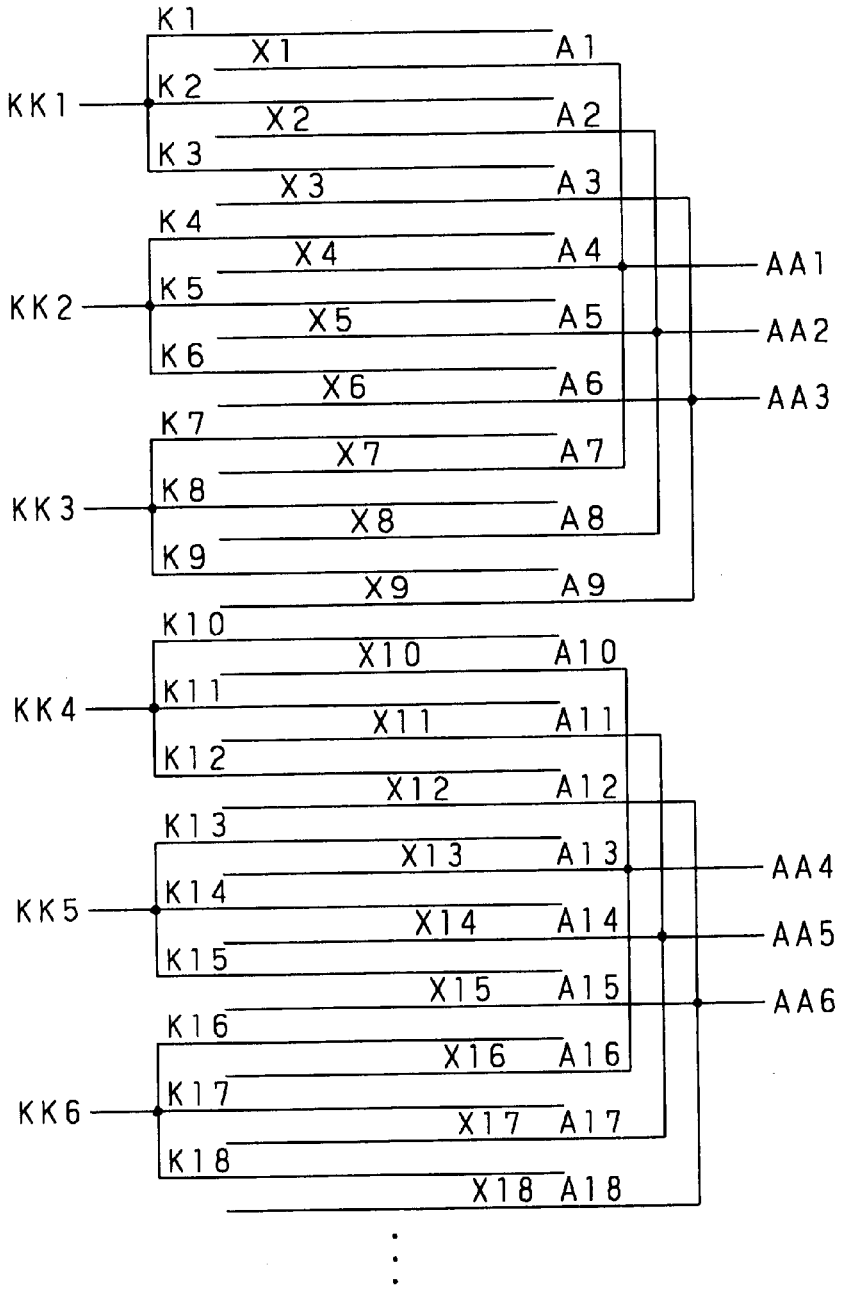
FIG. 6 is a diagram showing the multi-line connection incorporated in the display apparatus according to the first embodiment of the invention.

FIG. 6 shows the multi-line connection incorporated in the display apparatus according to the first embodiment of the invention. More precisely, FIG. 6 shows the most basic multi-line connection of anode electrodes A and cathode electrodes K, which is designed to drive each discharge channel by using two electrodes. This multi-line connection is characterized in that any three adjacent anode electrodes A make one group and any three adjacent cathode electrodes K make one group. Thus, two electrodes can drive one discharge channel in the discharge channel arrangement shown in FIG. 15, which will be described later.

In FIG. 6, the numbers identifying the anode electrodes A and cathode electrodes K indicate the order in which the anode electrodes and the cathode electrodes are arranged in the same column. Symbols KK are shown in FIG. 6. Each symbol KK represents a multi-connection line that connects the cathode electrodes that constitute one group. The numbers added to the symbols KK indicate the order in which the groups of cathode electrodes are arranged. The multi-connection line KK1 connects the cathode electrodes K1, K2 and K3, which form the first group. The multi-connection line KK2 connects the cathode electrodes K4, K5 and K6, which form the second group. The multi-connection line KK3 connects the cathode electrodes K7, K8 and K9, which form the third group. The other multi-connection lines KK4, KK5 each connect three cathode electrodes, in similar manner.

In FIG. 6, symbols AA are shown. Each symbol AA represents the multi-connection line that connects the anode electrodes forming one group. The numbers added to the symbols AA indicate the order in which the groups of anode electrodes are arranged. The multi-connection line AA1 connects the anode electrodes A1, A4, and A7, which form the first group. The multi-connection line AA2 connects the cathode electrodes A2, A5 and A9, which form the second group. The multi-connection line AA3 connects the anode electrodes A3, A6 and A8, which form the third group. The other multi-connection lines AA4, AA5 each connect three anode electrodes, in similar manner.

Each letter x in FIG. 6 shows the position where plasma discharge occurs between one cathode electrode K and the corresponding anode electrode A. The numbers added to the letters x represent the order in which the plasma discharge takes place. The plasma discharge at the position x1 occurs between the cathode electrode K1 connected to the multi-connection line KK1 and the anode electrode A1 connected to the multi-connection line AA1. The plasma discharge at the position x2 occurs between the cathode electrode K2 connected to the multi-connection line KK1 and the anode electrode A2 connected to the multi-connection line AA2. The plasma discharge at the position x3 occurs between the cathode electrode K3 connected to the multi-connection line KK1 and the anode electrode A3 connected to the multi-connection line AA3. Any other plasma discharge occurs between one cathode electrode of a group and one anode electrode of a group, as is illustrated in FIG. 6.

Figure 7:
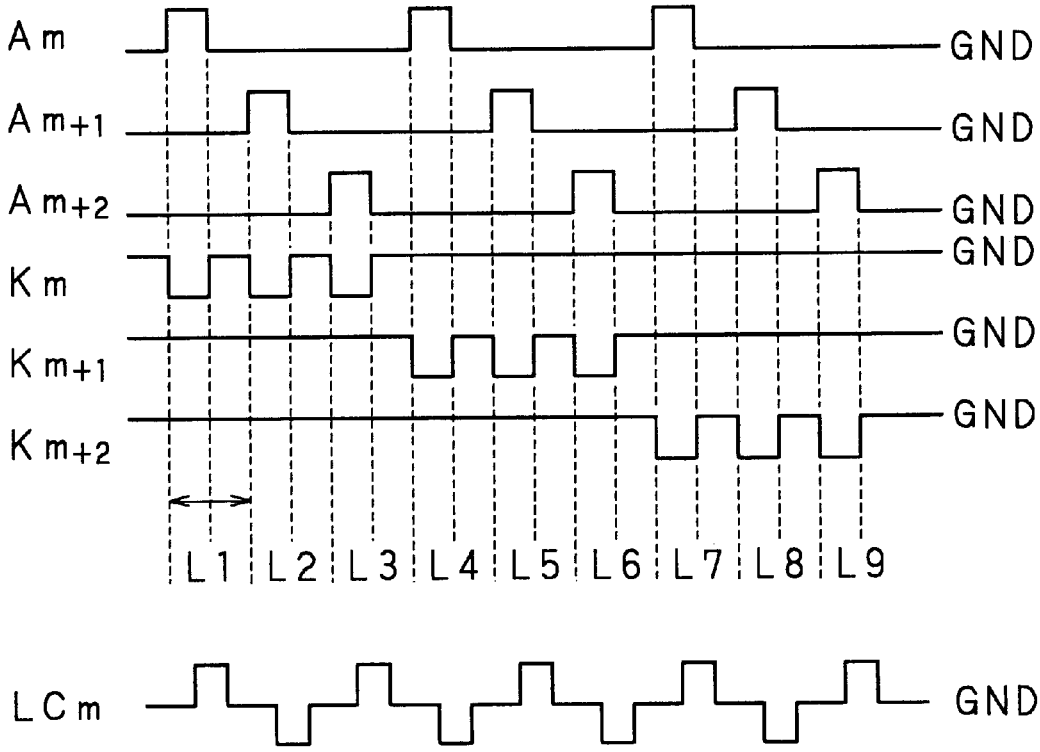
FIG. 7 is a chart illustrating the waveforms of drive signals supplied through the multi-line connection of the first embodiment.

FIG. 7 shows the waveform of a liquid-crystal drive signal LCm, anode drive signals, and cathode drive signals, all used in the present embodiment. The liquid-crystal drive signal LCm drives the transparent electrodes to accomplish horizontal canning. The anode drive signals are supplied to the anode electrodes Am to Am+2. The cathode drive signals are supplied to the cathode electrodes Km to Km+2. When an anode drive signal is supplied to an anode electrode and a cathode drive signal is supplied to a cathode electrode, one pixel is elected and driven. The anode drive signal and the cathode drive signal are of the opposite polarities. This not only reduces the number of circuit outputs and lowers the drive voltage, but also achieves sequential line scanning that is apparently the same as the one hitherto accomplished.

The first embodiment satisfies the conditions (1) to (3) described below and uses the multi-line connections shown in FIG. 6 and the drive signals having the waveforms shown in FIG. 7. The first embodiment can therefore effect sequential line scanning that is apparently the same as the one hitherto achieved, at low cost and low withstand voltage.

(1) The anode electrodes A and the cathode electrodes K are grouped, and the electrodes of each group are connected to the same drive circuit output.

(2) Two select a pixel, two voltages of opposite polarities with respect to the reference potential are applied to an anode electrode A and a cathode electrode K, respectively.

(3) The voltages applied to an anode electrode A and a cathode electrode K are of such values that discharge occurs when both the anode electrode and the cathode electrode are driven in the same channel, but does not take place when only an anode electrode A or only a cathode electrode K is driven.

The use of the multi-connection lines described above and the use of the drive signals specified above result in two advantages. First, the number of circuit outputs is reduced because of the condition (1). Second, the withstand voltage for the circuit outputs is lowered due to the condition (2). As simulation results show, these advantages can achieve synergetic effect of decreasing the circuit cost to about a tenth of the circuit cost hitherto required. Further, since the electrodes can be grouped in the circuit substrate, there is no need to alter the wiring design of the PALC display panel. Therefore, the multi-connection lines can be easily provided and can be readily driven.

Figure 8:
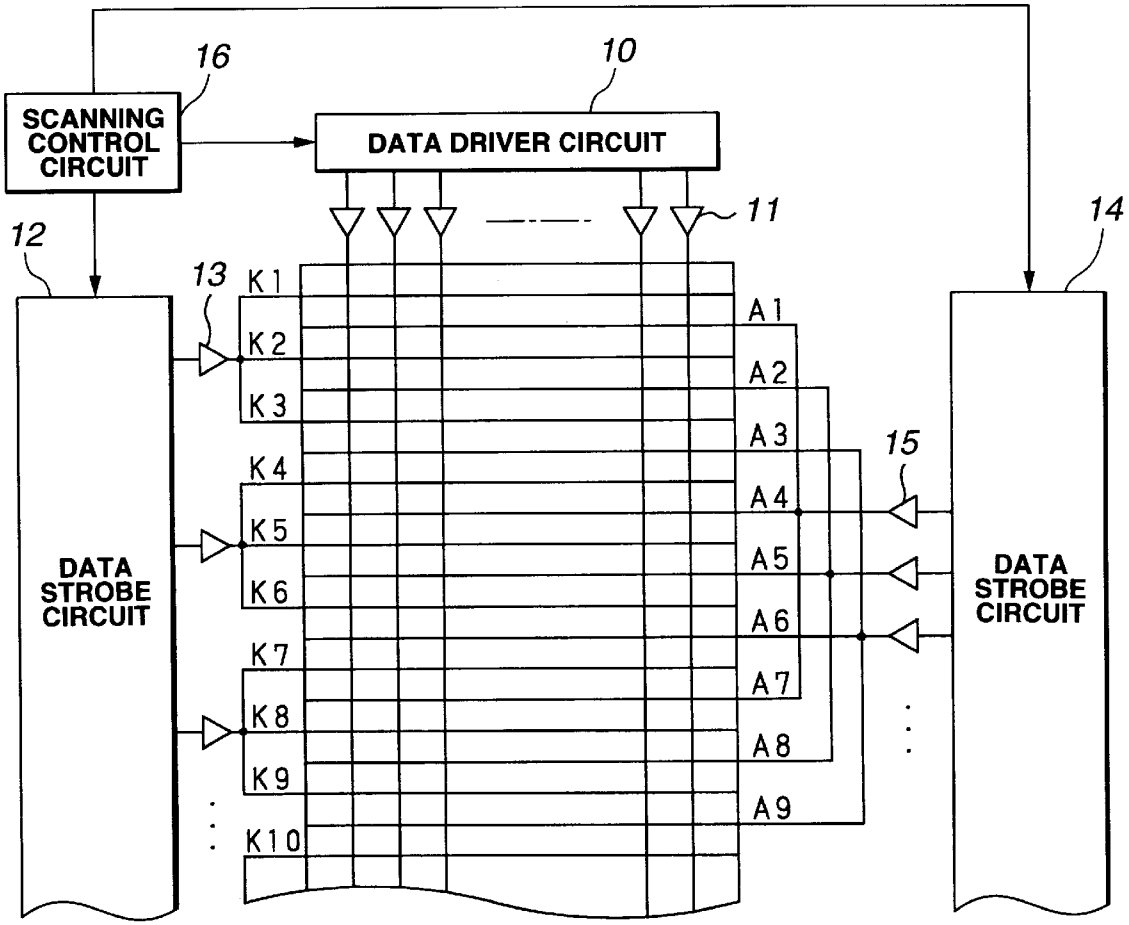
FIG. 8 is a block circuit diagram showing the display apparatus that is the first embodiment of this invention.

FIG. 8 is a schematic representation of the display apparatus according the first embodiment. More precisely, it shows the arrangement of the transparent electrodes, anode electrodes A and cathode electrodes K.

As FIG. 8 shows, the transparent electrodes are connected to a transparent electrode driving section that comprises a data driver circuit 10 and output amplifiers 11. Each output amplifier 11 generates an analog voltage, which is used as a liquid-crystal drive signal.

The cathode electrodes K1, K2, K3, are connected to a cathode electrode driving section that comprises a data strobe circuit 12 and output amplifiers 13, each provided for one multi-connection line connecting cathode electrodes. Each output amplifier 13 generates a data strobe signal, or a cathode drive signal (a pulse voltage) that has such a waveform as shown in FIG. 7. The anode electrodes A1, A2, A3, are connected to an anode driving section that comprises a data strobe circuit 14 and output amplifiers 15, each provided for one multi-connection line connecting anode electrodes. Each output amplifier 15 generates a data strobe signal, or an anode signal (a pulse voltage) that has such a waveform as shown in FIG. 7.

The display apparatus of FIG. 8 comprises a scanning control circuit 14 which is connected to the data driver circuit 10 and data strobe circuits 12 and 14. The scanning control circuit 14 is designed to adjust the functions of the data driver circuit 10 and data strobe circuits 12 and 14 in order to designate addresses of lines for all columns of pixels in the liquid crystal layer incorporated in the display apparatus.

In this display apparatus, the liquid crystal layer works as a capacitor for sampling the analog voltage applied to the transparent electrodes. The plasma discharges generated in the discharge chambers work as sampling switches. As the liquid crystal layer and the plasma discharges work so, the apparatus displays images.

Suppose an PALC display apparatus has anode and cathode electrodes connected by multi-connection lines, which are driven in the same manner as in the first embodiment. Then, the images the PALC display apparatus displays may deteriorate in quality in some cases. For instance, quasi-stable atoms may decay for a time longer than the horizontal scanning period, inevitably causing write errors and ultimately deteriorating the image quality.

In the PALC display apparatus, the voltage applied to the transparent electrodes at the time of discharging the discharge channels serves to write data into the liquid crystal layer. More strictly speaking, the writing of data completes the moment the quasi-stable atoms generated by discharge decay.

If the quasi-stable atoms may decay for a time longer than the horizontal scanning period, the writing of data at a scanning line is influenced by the writing of data at the next scanning line (i.e., the next discharge channel). That is, write errors will be made during multiple drive if the quasi-stable atoms have a lifetime longer than the time required to select one scanning line. This is because, after the scanning line is discharged, a voltage is applied to the discharge electrode to select the next scanning line. The write errors cause the deterioration of image quality, such as a decrease in contrast. In the conventional method of driving a display apparatus, the writing of data at the scanning line is influenced by the writing at the scanning line, but only a little. This is because both the anode electrode and the cathode electrode for a scanning line are fixed at the reference potential when the next scanning line is selected. In the method in which the anode and cathode electrodes are multi-line connected as described above, however, the writing of data at a scanning line is much influenced by the writing at the next scanning line, since the potential of the discharge electrode for the scanning line greatly changes from the reference potential when the next scanning line is selected.

To solve this problem, a voltage is applied to any two discharge electrodes at the same position, with a time lag of at least one scanning period, in the second embodiment of the present invention. In other words, the display apparatus is driven such that the same electrode is not continuously selected twice.

The second embodiment is characterized in two respects. First, the display apparatus has specific multi-line connection shown in FIG. 9. Second, the display apparatus is driven by a method using drive signals having the waveforms shown in FIG. 10. Hence, the same electrode would not be continuously selected twice. The quasi-stable atoms therefore fully decay until the electrode is selected again. The adverse influence on the image quality is much reduced, whereby the images the apparatus displays maintain high quality. The simple multi-line connection and the drive method, both according to the first embodiment, achieve a panel luminance of 6.9 Lx (luces), whereas the conventional drive method realizes a panel luminance of 12.5 Lx. By contrast, the multi-line connection and the drive method, according to the second embodiment, achieves a panel luminance accomplishes a panel luminance of 12.0 Lx. This indicates that the influence of the writing of data at the scanning line selected next is much decreased.

Second Embodiment

Figure 9:
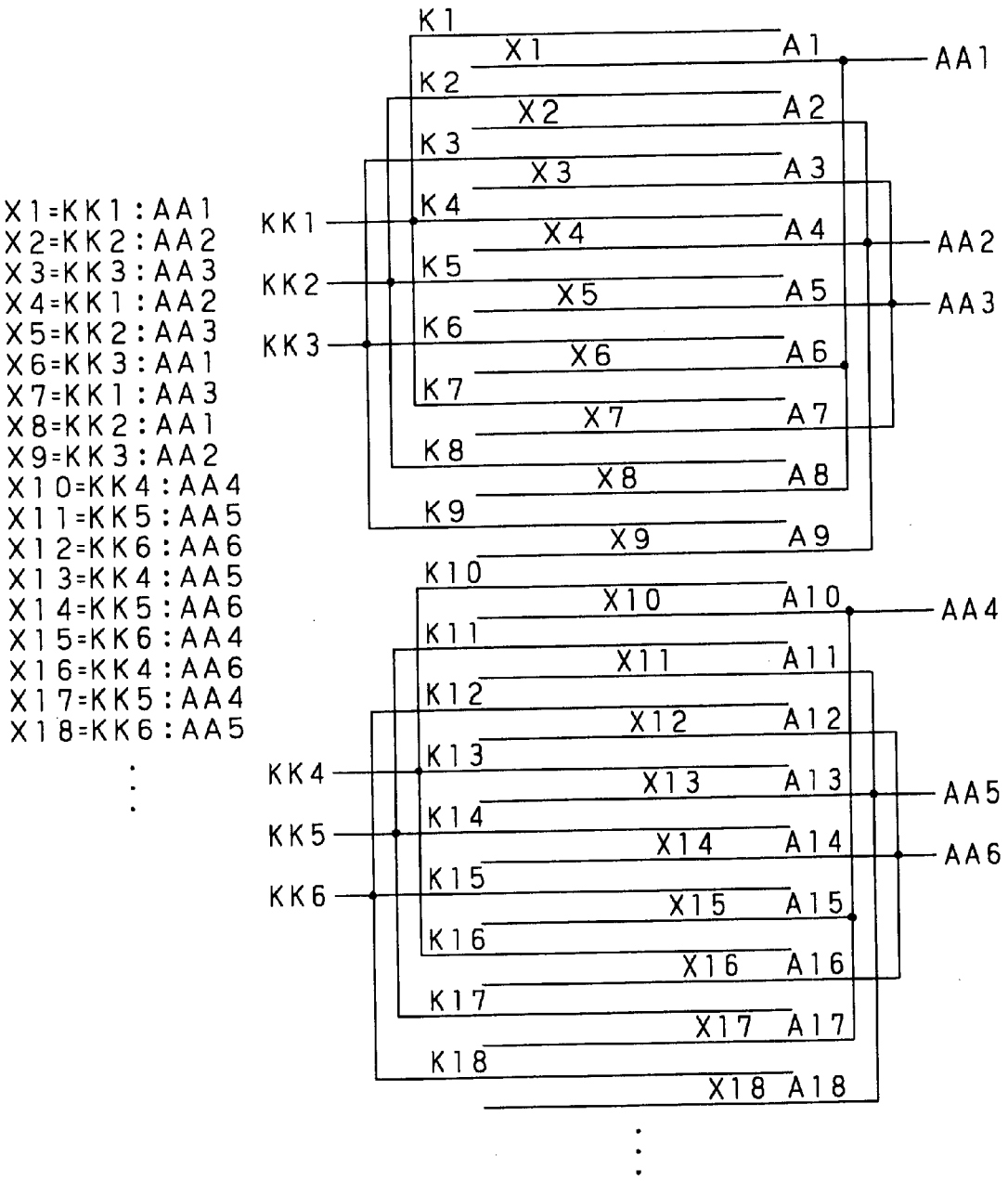
FIG. 9 is a diagram showing the multi-line connection incorporated in the display apparatus according to the second embodiment of the invention.
Figure 10:
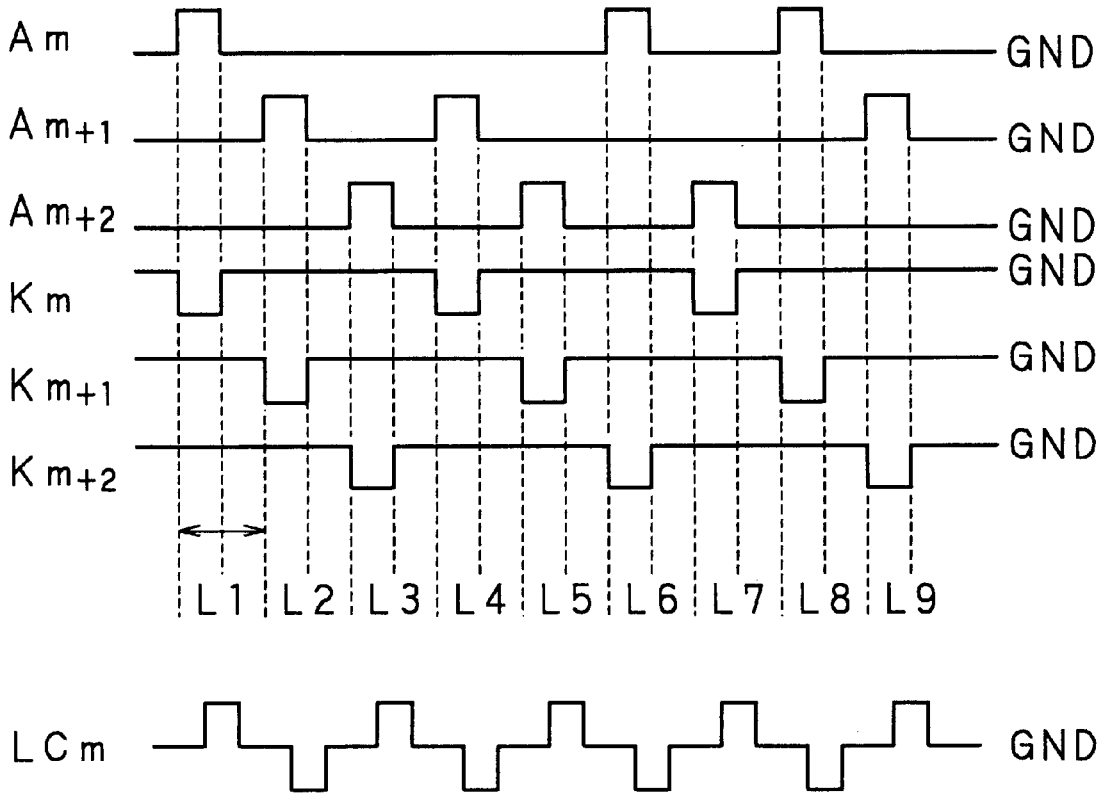
FIG. 10 is a chart depicting the waveforms of drive signals supplied through the multi-line connection of the second embodiment.

FIG. 9 is a diagram showing the multi-line connection incorporated in the display apparatus according to the second embodiment of the invention. The multiplicity of the line connection is 3 in the second embodiment. FIG. 10 shows the waveforms of a liquid-crystal drive signal LCm, anode drive signals, and cathode drive signals, all used in the second embodiment that employs this specific multi-line connection.

In FIG. 9, the numbers added to the letters K and A, which indicate cathode electrodes and anode electrodes, represent the order in which the cathode electrodes and the anode electrodes are arranged in the respective columns. Each symbol KK represents the multi-connection line connecting the cathode electrodes that constitute one group. The numbers added to the symbols KK indicate the order in which the groups of cathode electrodes are arranged. In the second embodiment, the multi-connection line KK1 connects the cathode electrodes K1, K4 and K7, which form the first group. The multi-connection line KK2 connects the cathode electrodes K2, K5 and K8, which form the second group. The multi-connection line KK3 connects the cathode electrodes K3, K6 and K9, which form the third group. The other multi-connection line KK4, KK5 each connects three cathode electrodes, in similar manner, as is illustrated in FIG. 9.

Each symbol AA in FIG. 9 represents the multi-connection line connecting the anode electrodes that constitute one group. The numbers added to the symbols AA indicate the order in which the groups of anode electrodes are arranged. The multi-connection line AA1 connects the anode electrodes A1, A6 and A8, which form the first group. The multi-connection line AA2 connects the cathode electrodes A2, A4 and A9, which form the second group. The multi-connection line AA3 connects the anode electrodes A3, A5 and A7, which form the third group. The other multi-connection lines AA4, AA5 each connect three anode electrodes, in similar manner, as is depicted in FIG. 9.

Each letter x in FIG. 9 shows the position where plasma discharge occurs between one cathode electrode K and the corresponding anode electrode A. The numbers added to the letters x represent the order in which the plasma discharge takes place. The plasma discharge at the position x1 occurs between the cathode electrode K1 connected to the multi-connection line KK1 and the anode electrode A1 connected to the multi-connection line AA1. The plasma discharge at the position x2 occurs between the cathode electrode K2 connected to the multi-connection line KK2 and the anode electrode A2 connected to the multi-connection line AA2. The plasma discharge at the position x3 occurs between the cathode electrode K3 connected to the multi-connection line KK3 and the anode electrode A3 connected to the multi-connection line AA3. Any other plasma discharge occurs between one cathode electrode of a group and one anode electrode of a group, as is illustrated in FIG. 9.

The display apparatus having the multi-line connection shown in FIG. 9 is driven by the signals illustrated in FIG. 10. The liquid-crystal drive signal LCm drives the transparent electrodes to accomplish horizontal canning. The anode drive signals are supplied to the anode electrodes Am to Am+2. The use of these drive signals not only reduces the number of circuit outputs and lowers the drive voltage, but also accomplish sequential line scanning that is apparently the same as the one hitherto accomplished.

As can be seen from FIG. 9, three multi-connection lines KKm, KKm+1 and KKm+2 connecting cathode electrodes are driven in the order mentioned (i.e., KKm→KKm+1→KKm+2), three times. Thereafter, value m is set to m+3 (m=m+3), whereby other three multi-line connections of cathode electrodes are driven in the same way. In the meantime, three multi-connection lines KKm, KKm+1 and KKm+2 connecting anode electrodes are driven three times, first in the order of (AAm→AAm+1→AAm+2), then in the order of (Aam+1→AAm+2→AAm), and finally in the order of (Aam+2→AAm→AAm+1). Thereafter, value m is set to m+3 (m=m+3), whereby other three multi-line connections of anode electrodes are driven in a similar manner. Since the multi-connection lines connecting the cathode electrodes and the multi-connection lines connecting the anode electrodes are so driven, the scanning lines can be selected, no matter how many scanning the display apparatus has. If the display apparatus has more scanning lines, it only needs to increase the value m. The multiplicity of line connection is not limited to 3 in the second embodiment. Any other multiplicity can be applied to the second embodiment. The multiplicity of line connection is, however, restricted mainly by the capacity-load driving ability of the output of the semiconductor device incorporated in the display apparatus.

The second embodiment satisfies the following condition (4), as well as the conditions (1) to (3) described above, and uses the multi-line connection shown in FIG. 9 and the drive signals having the waveforms shown in FIG. 10. The first second can therefore effect sequential line scanning that is apparently the same as the one hitherto achieved, at low cost and low withstand voltage.

(4) The same electrode is not continuously selected twice, and the electrodes are selected at as long time intervals as possible.

A drive circuit which effects the sequential line scanning with such regularity as mentioned above may be provided in two types. The first type is a combination of a logic IC and discrete FETs, each connected to the output of the logic IC. The second type comprises an IC which performs random access like a so-called PDP data driver and which has the voltage-current characteristic required for plasma discharge.

Figure 11:
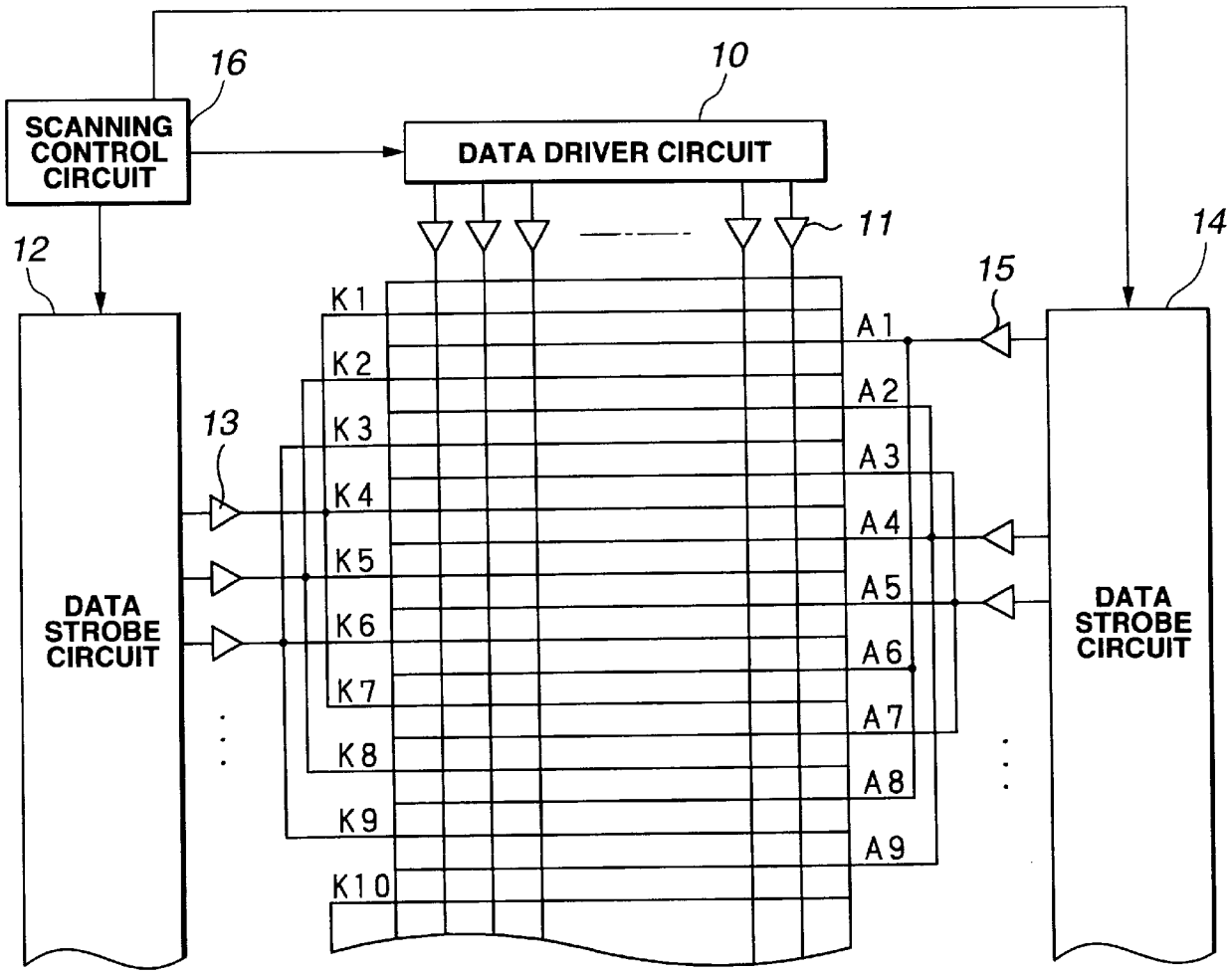
FIG. 11 is a block circuit diagram showing the display apparatus that is the second embodiment of this invention.

FIG. 11 is a schematic representation of the display apparatus according the second embodiment. More precisely, it shows the arrangement of the transparent electrodes, anode electrodes A and cathode electrodes K.

The display apparatus shown in FIG. 11 comprises output amplifiers 13 provided for the multi-connection lines connecting cathode electrodes, respectively. Each output amplifier 13 generates a data strobe signal, or a cathode signal (a pulse voltage) that has such a waveform as shown in FIG. 10. The display apparatus further comprises output amplifiers 15 provided for the multi-connection lines connecting the anode electrodes, respectively. Each output amplifier 15 generates a data strobe signal, or an anode signal (a pulse voltage) that has such a waveform as shown in FIG. 10.

The first and second embodiment, the multi-line connection and drive method of which have been described above, have the most basic discharge channel arrangement in which two electrodes drive one discharge channel. The discharge channel arrangement is not limited to this basic one. A discharge channel arrangement shown in FIG. 16, in which three electrodes drive one discharge channel as will be described later, or some other discharge channel arrangements may be utilized in the present invention. The alternative discharge channel arrangements serve to achieve the same advantages as attained by the first and second embodiments, only if they are modified a little, provided that it satisfies the conditions (1) to (4) mentioned above.

Figure 12:
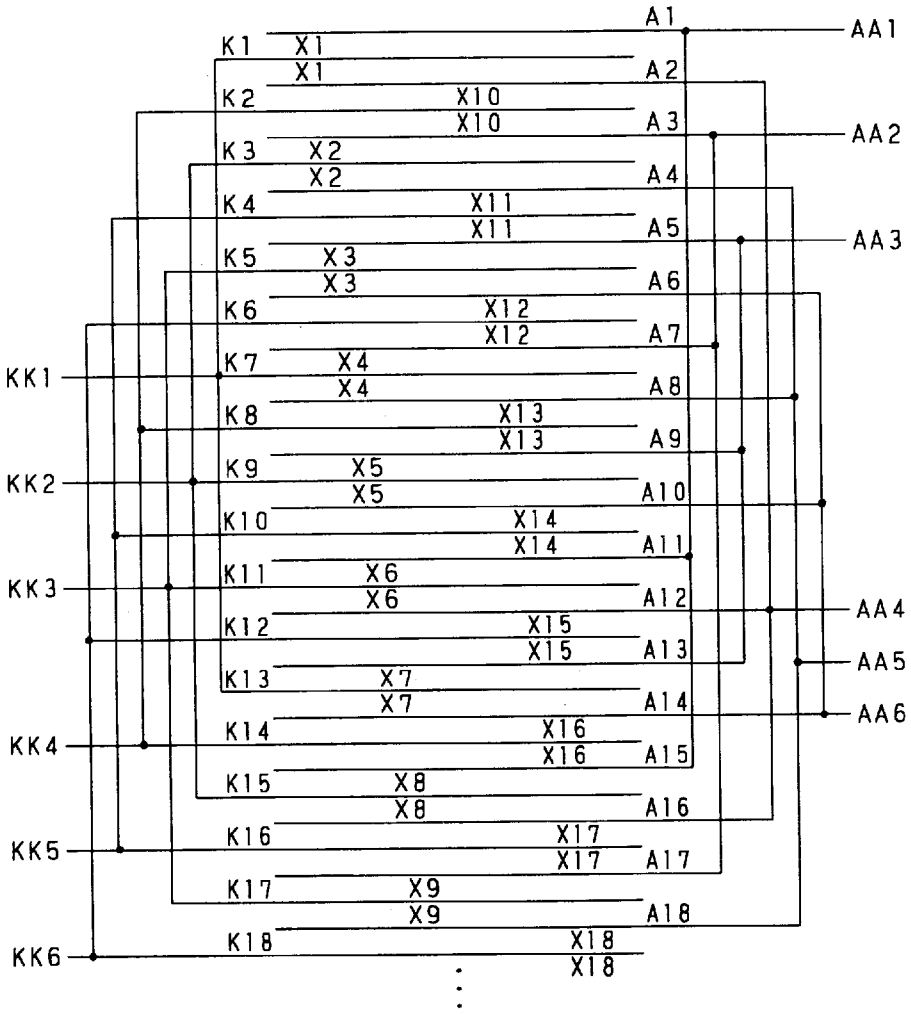
FIG. 12 is a diagram showing the multi-line connection used in the display apparatus according to the third embodiment of the invention.
Figure 14:
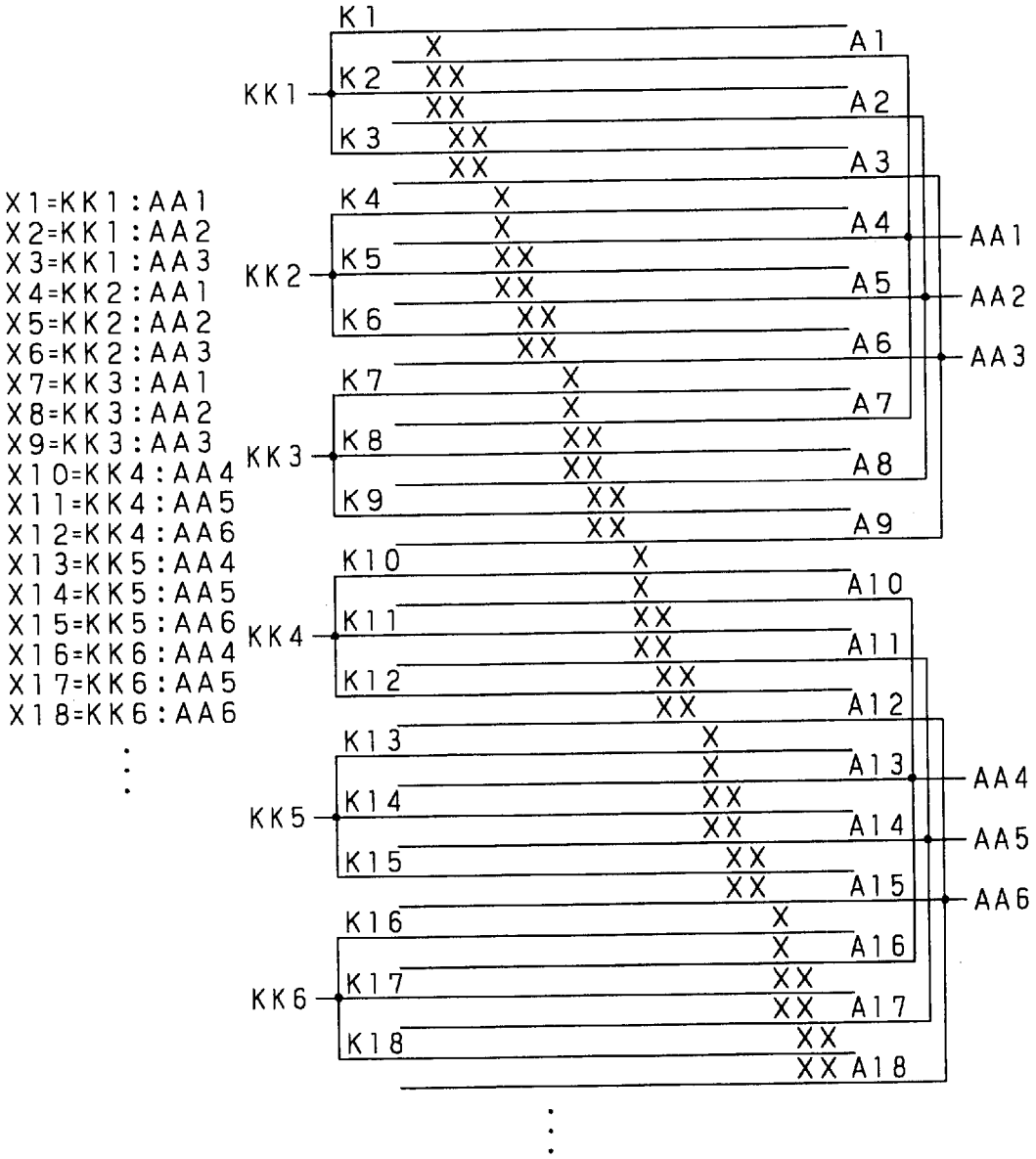
FIG. 14 is a diagram showing the multi-line connection provided in the display apparatus according to the fourth embodiment of the invention.

FIG. 12 shows the multi-line connection used in the display apparatus according to the third embodiment of the invention. FIG. 14 illustrates the multi-line connection incorporated in the display apparatus according to the fourth embodiment of the invention.

Third Embodiment

The third embodiment that has the multi-line connection of FIG. 12 satisfies not only the conditions (1) to (3), but also the condition (4). In the third embodiment, interlaced scanning is carried out to satisfy the condition (4). The scanning is effected at twice the speed of ordinary scanning by the use of a frame memory, thereby to prevent the flickering of the liquid crystal pixels. In some cases, the polarity of the liquid-crystal drive signal may be inverted in each field, whereby data is written twice.

In FIG. 12, the numbers added to the letters K and A, which indicate cathode electrodes and anode electrodes, represent the order in which the cathode electrodes and the anode electrodes are arranged in the respective columns. Each symbol KK represents the multi-connection line connecting the cathode electrodes that constitute one group. The numbers added to the symbols KK indicate the order in which the groups of cathode electrodes are arranged. In the third embodiment, the multi-connection line KK1 connects of the cathode electrodes K1, K7 and K13, which form the first group. The multi-connection line KK2 connects the cathode electrodes K3, K9 and K15, which form the second group. The multi-connection line KK3 connects the cathode electrodes K5, K11 and K17, which form the third group. The other multi-connection lines KK4, KK5 each connect three cathode electrodes, in similar manner, as is illustrated in FIG. 12. Each symbol AA in FIG. 12 represents the multi-connection line connecting the anode electrodes that constitute one group. The numbers added to the symbols AA indicate the order in which the groups of anode electrodes are arranged. The multi-connection line AA1 connects the anode electrodes A1, A11 and A15, which form the first group. The multi-connection line AA2 connects the cathode electrodes A3, A7 and A17, which form the second group. The multi-connection line AA3 connects the anode electrodes A5, A9 and A13, which form the third group. The other multi-connection lines AA4, AA5 each connect three anode electrodes, in similar manner, as is depicted in FIG. 12.

Each letter x in FIG. 12 shows the position where plasma discharge occurs between one cathode electrode K and the corresponding anode electrode A. The numbers added to the letters x represent the order in which the plasma discharge takes place. The plasma discharge at the position x1 occurs between the cathode electrode K1 connected to the multi-connection line KK1 and the anode electrode A1 connected to the multi-connection line AA1 and between the cathode electrode K1 and the anode electrode A2 connected to the multi-connection line AA4. The plasma discharge at the position x2 occurs between the cathode electrode K3 connected to the multi-connection line KK2 and the anode electrode A3 connected to the multi-connection line AA2 and between the cathode electrode K3 and the anode electrode A4 connected to the multi-connection line AA5. The plasma discharge at the position x3 occurs between the cathode electrode K5 connected to the multi-connection line KK3 and the anode electrode A3 connected to the multi-connection line AA3 and between the cathode electrode K5 and the anode electrode A6 connected to the multi-connection line AA6. Any other plasma discharge occurs between one cathode electrode connected to a multi-connection line and two anode electrodes connected to two different multi-connection lines, as is illustrated in FIG. 12.

The display apparatus according to the third embodiment, which has the multi-line connection shown in FIG. 12, is driven by liquid-crystal drive signal LCm, anode drive signals and cathode drive signals, which are of the same type used in each embodiment described above. The use of these drive signals not only reduces the number of circuit outputs and lowers the drive voltage, but also accomplish sequential line scanning that is apparently the same as the one hitherto accomplished.

Figure 13:
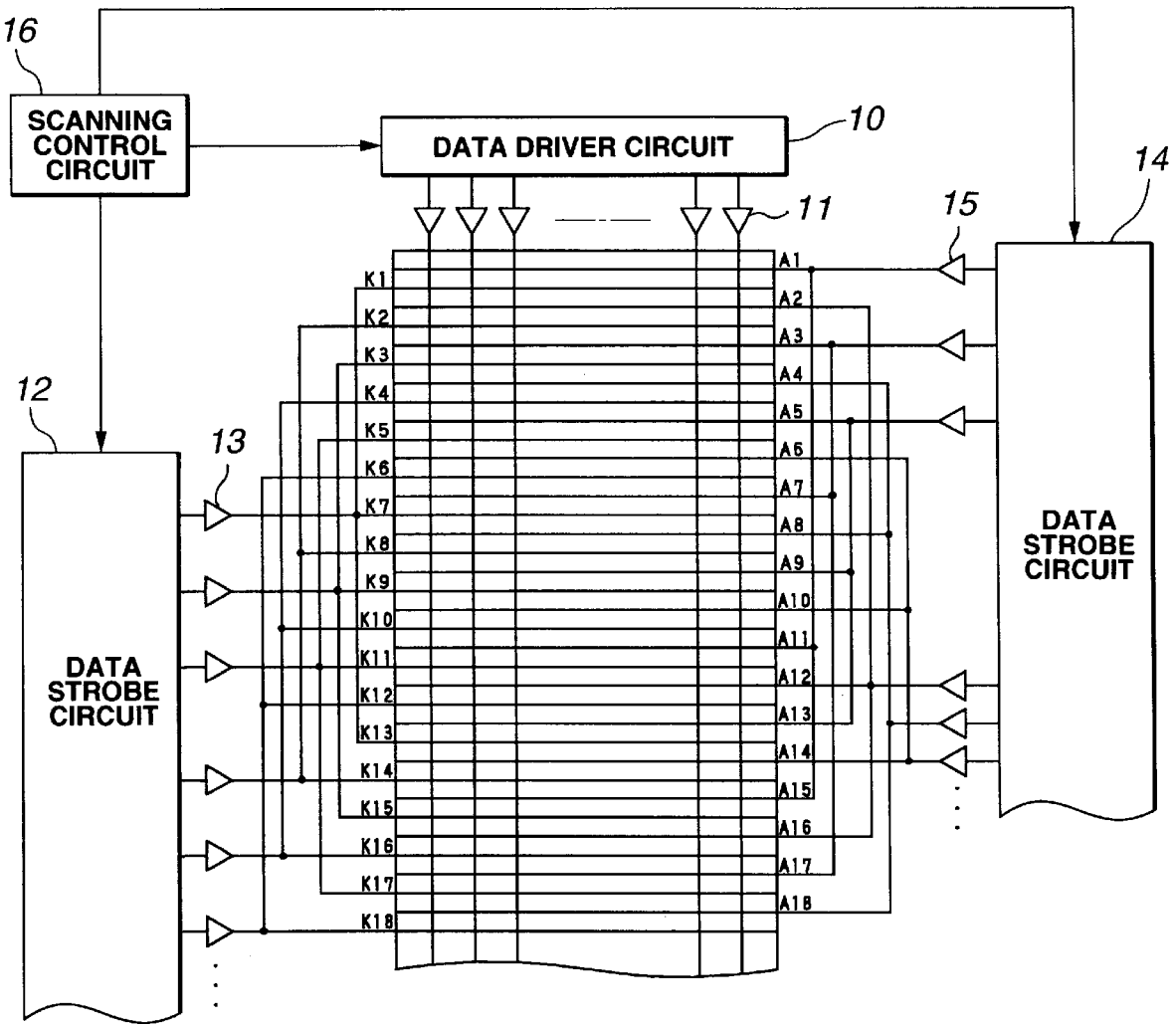
FIG. 13 is a block circuit diagram showing the display apparatus that is the third embodiment of this invention.

FIG. 13 is a schematic representation of the display apparatus that is the third embodiment of the invention. More correctly, it shows the arrangement of the transparent electrodes, anode electrodes A and cathode electrodes K.

The display apparatus shown in FIG. 13 comprises output amplifiers 13 provided for the multi-connection lines connecting the cathode electrodes, respectively. Each output amplifier 13 generates a data strobe signal, or a cathode signal (a pulse voltage). The display apparatus further comprises output amplifiers 15 provided for the multi-connection lines connecting the anode electrodes, respectively. Each of the output amplifiers 15 generates a data strobe signal, or an anode signal (a pulse voltage).

Fourth Embodiment

FIG. 14 shows the multi-line connection of the fourth embodiment, which is such a simple multi-line connection as used in the first embodiment and shown in FIG. 6. The display apparatus according to the fourth embodiment is driven by the same method as the apparatus according to the first embodiment. In the fourth embodiment, the discharge proceeds, each discharge overlapping another. Due to the characteristic of the liquid crystal used, the signal written last is held until the next discharge is effected. The image, as a whole, therefore has no great defects.

The most basic discharge channel arrangement, in which two electrodes drive one discharge channel, will be described with reference to FIG. 15.

As shown in FIG. 15, a display apparatus, wherein two electrodes drive one discharge channel, comprises a first substrate 1, a liquid crystal layer 3, a dielectric film 4, and a second substrate 9. The first substrate 1 is flat and sufficiently transparent to light. The second substrate 9 is flat, too. The liquid crystal layer 3, i.e., an electrooptic layer, is interposed between the first substrate 1 and the dielectric film 4. A space 6, or discharge region, is provided between the dielectric film 4 and the second substrate 9.

Both substrates 1 and 9 are made of material that is electrically non-conductive and optically transparent. This is because the display apparatus is a transmission type. If the display apparatus is a direct-view type or a reflection type, only one of the substrates 1 and 9 needs to be transparent.

On a major surface 1*a* of the first substrate 1, strip-shaped electrodes 2 are formed, and the liquid crystal layer 3 is provided, covering the electrodes 2. The layer 3 is made of nematic liquid crystal or the like. As mentioned above, the liquid crystal layer 3 is interposed between the first substrate 1 and the dielectric film 4. The film 4 is thin and made of glass, mica, plastic or the like. The first substrate 2, liquid crystal layer 3 and dielectric film 4 constitute so-called liquid crystal cells.

The dielectric film 4 functions as a partition for insulating the liquid crystal layer 3 from the discharge region 6. Without the dielectric film 4, the liquid crystal might flow into to the discharge region 6 and might be contaminated with the gas present in the region 6. The dielectric film 4 need not be provided if the liquid crystal is replaced with either solid electrooptic material or encapsulated electrooptic material.

Since the film 4 is made of dielectric material, it functions as a capacitor, too. It should therefore be as thin as possible to remain electrically coupled with the liquid crystal layer 3 and to inhibit secondary diffusion of an electric charge.

On the second substrate 9, there are formed discharge-electrode groups 7 of anode electrodes A and discharge-electrode groups 8 of cathode electrodes K. The anode electrodes A and cathode electrodes K are shaped like a strip. A frame-shaped seal (not shown) is provided between the dielectric film 4 and the second substrate 9. The seal sets the second substrate 9 apart from the film 4 for a predetermined distance and defines a closed space, i.e., the discharge region 6. It is in the discharge region 6 that discharge plasma is generated.

Barrier ribs 5 formed by printing partition the discharge region 6 into a plurality of plasma chambers.

Each of the plasma chambers is filled with gas that can be ionized. The gas is helium, neon, argon, a mixture of these gases, or the like.

The barrier ribs 5 extend parallel to the strip-shaped electrodes of the discharge-electrode groups 7 and 8 and are arranged between the strip-shaped electrodes. Each barrier rib 5 is provided for one anode electrode A and one cathode electrode K which form a pair of electrodes. In other words, each barrier rib 5 is provided for one scanning line. It follows that each plasma chamber corresponds to one scanning line.

As stated above, the barrier ribs 5 are formed by means of printing. More specifically, glass paste, for example, is applied several times by screen-printing, thereby forming the barrier ribs 5. It should be noted that the barrier ribs 5 serve as spacers, determining the height of the discharge region 6 (i.e., the distance between the dielectric film 4 and the second substrate 9). The height W can be controlled by changing the number of times the glass paste is applied or by adjusting the amount of glass paste applied each time.

In each plasma chamber the discharge electrodes 7 and 8 can be formed directly on the second substrate 9. They can be formed by applying, for example, an electrically conductive paste containing Ag powder or the like to the second substrate 9. Alternatively, they may be formed, of course, by an etching process. In whichever case, the discharge electrodes can be easily formed because they are formed on a flat surface, and can be spaced apart by such a precise distance as is desired.

In the process of manufacturing the display apparatus, the groups 7 and 8 of discharge electrodes are formed on the flat second substrate 9. Thereafter, the barrier ribs 5 are formed on the second substrate 9 by means of printing.

The discharge channel arrangement, in which three electrodes drive one discharge channel, will be described with reference to FIG. 16. In FIG. 16 the components similar or identical to those shown in FIG. 15 are designated at the same reference numerals and symbols.

In the display apparatus of FIG. 16, too, the liquid crystal layer 3 made of electrooptic material is interposed between the first substrate 1 and the dielectric film 4. Discharge-electrode groups 7 and 8 are provided on the first substrate 1. The space between the dielectric film 4 and the second substrate 9 serves as a discharge region 6.

In the structure shown in FIG. 16, the discharge electrodes 7, e.g., anode electrodes A, are arranged at regular intervals. Barrier ribs 5 are formed on the discharge electrodes 7, respectively, by means of printing. The ribs 5 partition the discharge region 6 into a plurality of plasma chambers. This specific structure cannot be attained unless the barrier ribs 5 are formed by printing to partition the discharge region 6.

Once the barrier ribs 5 have been formed on the discharge electrodes 7 by means of printing, the plasma chambers are provided. Each discharge electrode 7 is commonly used in two adjacent plasma chambers. Otherwise it should be necessary to provide twice as many discharge electrodes.

The barrier ribs 5 overlap the discharge electrodes 7. It should be noted that the barrier ribs 5 contribute nothing to the image displaying. These facts help to increase the numerical aperture of the display apparatus. Thus, they ultimately enhance the optical characteristic of the display apparatus.

As has been described, the cathode electrodes and anode electrodes are connected, forming groups each consisting of N electrodes, in each of the embodiments. Hence, the number of circuit outputs required is reduced to half the number N of circuit outputs necessarily provided in the conventional display apparatus.

In each embodiment of this invention, the output voltage of the drive circuit can be reduced to half the output voltage of the drive circuit incorporated in the conventional display apparatus. The output voltage may be decreased from 500 V to 250 V. If this is the case, the IC cost for each output is estimated to a third (⅓) of the IC cost in the conventional display apparatus.

With each embodiment of the invention it is possible to reduce the number of circuit outputs and decrease the withstand voltage for the circuit outputs. The reduction in the number of circuit outputs and the decrease in the withstand voltage achieve synergetic effect of greatly decreasing the circuit cost.

With the second embodiment it is possible to greatly reduce the adverse influence that quasi-stable atoms imposes on the image quality when simple multi-line connection and a simple drive method are used in a PALC display apparatus. The display apparatus according to the second embodiment can therefore display images in high contrast comparable to the contrast attained in the conventional display apparatus.

As has been described, discharge electrodes are divided into groups in the display apparatus and the method of driving a display apparatus, both according to the present invention. The discharge electrodes of each group are connected to one another. Two voltages of the opposite polarities are applied to the selected two of the discharge-electrode groups, respectively. This can provide a so-called PALC display apparatus at low cost, which displays images of good quality. That is, the multi-line connection of discharge electrodes reduces the number of circuit outputs and lowers the voltage applied to the discharge electrodes to half the value applied in the conventional display apparatus, while ensuring the displaying of high-quality images. The present invention can therefore greatly decrease the circuit cost of the display apparatus.

What is claimed is:

1. A display apparatus comprising:

a first electrode layer having a plurality of first electrodes extending substantially parallel to one another;

a second electrode layer having a plurality of second electrodes extending substantially parallel to one another, each composed of at least one pair of discharge electrodes, and arranged with the second electrodes opposing the first electrodes and extending to the first electrodes;

an electrooptic layer provided between the first electrode layer and the second electrode layer and substantially contacting the first electrode layer, to be driven by said at least one pair of discharge electrodes; and a discharge region provided between the first electrode layer and the second electrode layer, filled with gas that can be ionized, and having barrier ribs extending substantially parallel to the second electrodes;

connection means dividing the second electrodes into groups with the second electrodes in a same pair of discharge electrodes not being in a same group and connecting the discharge electrodes included in each group to one another; and voltage-applying means for applying two voltages of opposite polarities to selected two of the groups, respectively, such that two voltages of same polarities are not applied to the second electrodes in the same pair of discharge electrodes, respectively.

2. A display apparatus according to claim 1, wherein a voltage is applied to the discharge electrodes at the same position, with a time lag of at least one scanning period, thereby to perform sequential line scanning.

3. A method of driving a display apparatus which comprises a first electrode layer having a plurality of first electrodes extending substantially parallel to one another; a second electrode layer having a plurality of second electrodes extending substantially parallel to one another, each composed of at least one pair of discharge electrodes, and arranged with the second electrodes opposing the first electrodes and extending to the first electrodes; an electrooptic layer provided between the first electrode layer and the second electrode layer and substantially contacting the first electrode layer, to be driven by said at least one pair of discharge electrodes; and a discharge region provided between the first electrode layer and the second electrode layer, filled with gas that can be ionized, and having barrier ribs extending substantially parallel to the second electrodes, said method comprising the steps of:

dividing the second electrodes into groups with the second electrodes in a same pair of discharge electrodes not being in a same group and connecting the discharge electrodes included in each group to one another; and applying two voltages of opposite polarities to selected two of the groups, respectively, such that two voltages of same polarities are not applied to the second electrodes in the same pair of discharge electrodes, respectively.

4. A method according to claim 3, wherein a voltage is applied to the discharge electrodes at the same position, with a time lag of at least one scanning period, thereby to perform sequential line scanning.

* * * * *